US007188660B2

(12) United States Patent
Grefhorst et al.

(10) Patent No.: US 7,188,660 B2
(45) Date of Patent: Mar. 13, 2007

(54) METHOD FOR PRODUCING A MOLDING SAND THAT IS IN PARTICULAR RECIRCULATED, FOR FOUNDRY PURPOSES

(75) Inventors: Cornelis Grefhorst, Zz Winterswijk (NL); Karl Koch, Borken (DE)

(73) Assignee: IKO Minerals GmbH, Marl (DE)

( * ) Notice: Subject to any disclaimer, the term of this patent is extended or adjusted under 35 U.S.C. 154(b) by 43 days.

(21) Appl. No.: 10/503,780

(22) PCT Filed: Feb. 7, 2003

(86) PCT No.: PCT/EP03/01226

§ 371 (c)(1),
(2), (4) Date: Jan. 10, 2005

(87) PCT Pub. No.: WO03/066253

PCT Pub. Date: Aug. 14, 2003

(65) Prior Publication Data

US 2005/0121168 A1 Jun. 9, 2005

(30) Foreign Application Priority Data

Feb. 7, 2002 (DE) ..... 102 05 158

(51) Int. Cl.
*B22C 1/02* (2006.01)
*B22C 1/18* (2006.01)

(52) U.S. Cl. ..... 164/529; 164/520

(58) Field of Classification Search ..... 164/520, 164/529; 106/38.3
See application file for complete search history.

(56) References Cited

U.S. PATENT DOCUMENTS

| | | | | |
|---|---|---|---|---|
| 4,422,496 | A * | 12/1983 | Seeney et al. | 164/528 |
| 5,641,015 | A * | 6/1997 | Challand | 164/528 |
| 6,372,032 | B1 * | 4/2002 | Miki | 106/38.2 |
| 6,447,593 | B1 * | 9/2002 | Sargent et al. | 106/38.4 |

FOREIGN PATENT DOCUMENTS

| | | |
|---|---|---|
| DE | 196 43 514 | 4/1998 |
| EP | 0 111 616 | 6/1984 |
| EP | 0 279 031 | 8/1988 |
| EP | 0 644 006 | 3/1995 |
| EP | 0 891 954 | 1/1999 |
| JP | 58-179536 A * | 10/1983 |
| WO | WO 98/17417 | 4/1998 |

* cited by examiner

*Primary Examiner*—Kevin P. Kerns
(74) *Attorney, Agent, or Firm*—Collard & Roe, P.C.

(57) ABSTRACT

A method is for producing a moulding sand that is in particular recirculated, for foundry purposes. A mixture of a granular substance and aggregates, such as a binding agent and water, are added to a material that is not capable of swelling in water. The latter material has cavities with a specific surface area of more than 10 $m^2/g$, in particular more than 50 $m^2/g$ and preferably more than 100 $m^2/g$, for improving the characteristics of the moulding sand and/or for reducing the emission of harmful and/or odorous substances.

17 Claims, 2 Drawing Sheets

Emission
8
9
10
11
12
13
0
20
40
60
80
100
Mass number
Benzene
Toluene

Emission
8
9
10
11
12
13
0
20
40
60
80
100
Mass number

METHOD FOR PRODUCING A MOLDING SAND THAT IS IN PARTICULAR RECIRCULATED, FOR FOUNDRY PURPOSES

CROSS REFERENCE TO RELATED APPLICATIONS

Applicants claim priority under 35 U.S.C. §119 of German Application No. 102 05 158.5 filed on Feb. 7, 2002. Applicants also claim priority under 35 U.S.C. §365 of PCT/EP03/01226 filed on Feb. 7, 2003. The international application under PCT article 21(2) was not published in English.

BACKGROUND OF THE INVENTION

1. Field of the Invention

The invention relates to a method for producing a molding sand, particularly one that is recirculated, for foundry purposes, according to which a mixture of a granular substance and additives, such as a binder and water, are added to a material that is not capable of swelling in water.

2. The Prior Art

It is known that in foundry technology, synthetic molding sands are used, which essentially consist of the refractory, granular basic substance, i.e. granular mass, and additives. The additives have various tasks. In particular, they are supposed to contribute to an improvement of the surface quality of the cast parts produced using the molding sand described. Binders are added to the molding sands as additives. These binders are usually natural inorganic binders, such as clays, particularly clays that contain montmorillonite, so-called bentonites.

Bentonites as molding sand binders are connected with the advantage that the molding sand can be recirculated, and that in this regard, treatment of the thermally stressed molding sand is possible. This presumes, of course, that its crystalline structure has not been destroyed by heat, which does or can apply for approximately 0.5 wt.-% of the bentonite per circulation cycle.

Treatment of the molding sand generally takes place by means of mixing water into the molding sand again, whereby approximately 1 wt.-% of additives (including bentonite) must be added. This can be attributed to the thermal burn-off at the contact surface of the molding sand, i.e. mold, with the cast part. During the molding substance or molding sand treatment, the molecules of water deposit in and on the binder (bentonite), causing the binder to form the ability to be able to bind the otherwise granular basic substance, i.e. granular mass. A measure of this binding ability and of the resulting strength properties of a compacted molding sand is, among other things, the so-called wet tensile strength, which is measured in $N/cm^3$. The wet tensile strength can be determined as indicated in EP 0 644 006 A1 and the VDG-Merkblatt [bulletin of the Verein Deutscher GieBereifachleute=Association of German Foundry Specialists] which is cited there.

In today's foundries, thermal stress on the molding sand or molding substance is great, furthermore the treatment times are short, and a significant influx of core sand, i.e. granular mass takes place. In order to reduce emissions, an effort is made to use little so-called glance carbon forming agents, e.g. hard coal dust. Accordingly, a molding sand having a low wash substance content as well as a low content of coking residues is obtained.

The low wash substance content expresses the fact that the proportion of particles having a low diameter of mostly less than 20 μm is small. As a result, the molding sand or molding substance becomes sensitive to water, in other words it reacts particularly strongly to changes in the amount of added water, so that control of the compaction of the mold sand becomes problematic.

Within the scope of EP 0 644 006 A1, a binder for foundry mold sand is described. This binder can be produced on the basis of alkali-activated earth alkali smectites. The earth alkali smectite, in each instance, is activated in the alkali form by means of an inorganic ion exchanger. Usually, the earth alkali smectite is calcium bentonite or calcium-magnesium bentonite. The problems of emission reduction as indicated above have not been significantly influenced by this state of the art. This also holds true for the method known from WO 98/17 417 A1, for the production of a molding sand for foundry purposes.

SUMMARY OF THE INVENTION

The present invention has as an object the further developing of a method of the kind described initially, in such a manner that the molding sand produced in this manner is particularly made capable for being used in a recirculating system, and is available at long useful lifetimes. Furthermore, the wet tensile strength is supposed to be increased, the water sensitivity is supposed to be decreased, and finally, the emission of odors and harmful substances is supposed to be reduced.

To achieve these objects, a method of this type is characterized in that the porous material that is not capable of swelling demonstrates cavities having a specific surface of more than 10 $m^2/g$, particularly more than 50 $m^2/g$, preferably more than 100 $m^2/g$, to improve the molding sand properties and/or adsorption and/or catalytic conversion of preferably harmful and/or odor causing substances.

Supplementally, the porous material in question, which is not capable of swelling, can also be treated chemically, specifically and particularly in the sense of the installation of cations and/or oxidants, i.e. oxidation agents. In this way, catalytic conversion of harmful and/or odor-causing substances that are formed during pyrolysis for example, can be achieved. Certain harmful substances can also be converted to non-toxic substances, in targeted manner. Just as well, the formation process of harmful substances from crack products, for example, or the generation of free radicals, can be interrupted right from the start. Along with the cations, oxidants, which also reduce the formation of harmful and/or odor-causing substances, can also be bound into the crystal structure of the porous material in question, which is not capable of swelling, alternatively or supplementally. In this connection, the installation of the cations can take place, as generally usual, in an aqueous solution that contains electrolytes. The method of procedure for installation of the oxidants is the same; they can be present in a corresponding solution and be built into the cavities of the porous material that is not capable of swelling, by means of wet-chemical treatment.

The porous material that is not capable of swelling, as described, serves, on the whole, not only to reduce harmful and/or odor-causing substances. Instead, at the same time, the material properties of the molding sand are improved, as a whole. This is particularly true with regard to an increase in the wet tensile strength and a reduction in the sensitivity to water, as will be explained in greater detail below.

Usually, the porous material that is not capable of swelling in water has channel-like cavities that serve to embed the harmful and/or odor-causing substances in question, without any significant change in the crystal structure.

This circumstance is of particular significance, because according to the teaching of the invention, the porous material that is not capable of swelling in water is conducted in a circulation system with the molding sand, as a whole, in other words it is not supposed to change its crystal structure for this reason. Otherwise, the casting result could be negatively affected by this.

As a rule, the material that is not capable of swelling has a low density of less than 3 g/cm$^3$, particularly of less than 2.5 g/cm$^3$. In this connection, it has proven to be advantageous to use specific silicates as the material that is not capable of swelling; their characteristic silicon/oxygen elementary tetrads are linked with one another on all sides, to form a three-dimensional structure. This means that the invention mostly recommends the use of structural silicates or tectosilicates, which form alkali and earth alkali aluminum silicates, with very few exceptions, as the porous material that is not capable of swelling. In addition, however, pumice or pumice stone, allophane, imogolite, siliceous earth, polygarskites, sepiolites, diatomaceous earth, as well as clays treated with acid and/or heat can be used as materials that are not capable of swelling. As a rule, however, structural silicates or tectosilicates are used.

In the case of aluminum silicates/tectosilicates, cations can be advantageously built in using the chemical treatment described; these cations, in combination with the oxidants already mentioned, if applicable, ensure, as a whole, that harmful substances either are not formed at all or are converted catalytically into other (non-polluting) substances. What is possible here, for example, is the reduction of harmful substances in connection with pyrolysis processes.

Such structural silicates or tectosilicates are characterized in that their structural framework is built to be very loose and open-meshed, thereby forming channel-like cavities. These channel-like cavities are primarily responsible for the great specific surface of more than 10 m$^2$/g, particularly more than 50 m$^2$/g, preferably more than 100 m$^2$/g, and open up the possibility of accommodating ions or molecules in these (cavities). Consequently, the cavities are available for adsorption of the harmful and/or odor-causing substances (as well as previously, if applicable, for the installation of the cations and/or oxidants).

Another consequence of the loose lattice structure of the tectosilicates, as described, is their low specific weight of clearly less than 3 g/cm$^3$, which actually lies below 2.3 g/cm$^3$, in most cases. In addition, the tectosilicates are characterized by an average hardness of 4 to 6, which exceeds that of bentonite (hardness 1 to 2). These hardness data are the so-called sclerometric hardness, which follows the Mohs hardness scale. With this, the tectosilicates lie in the range between quartz (hardness approximately 7) and the binder, i.e. bentonite, with a hardness of 1 to 2.

Consequently, the material that is not capable of swelling acts, i.e. the tectosilicates act in comparable manner to the granular mass, and can be easily built into the granular mass, even after the adsorption of harmful and/or odor-causing substances, because of their crystal stability, without any negative effects to be feared for the molding sand as a whole. Within the scope of the invention, zeolite is used as a preferred tectosilicate, and here, in particular, Fe zeolite or chabasite. Fundamentally, pumice or pumice stone, siliceous earth, but also clinoptilolith as well as various aluganes, and mixtures of the aforementioned materials, can be used in place of zeolite as the porous material that is not capable of swelling.

In total, it has proven to be advantageous to add the porous material that is not capable of swelling, i.e. the tectosilicate, to the molding sand in amounts of approximately 0.1 wt.-% to approximately 40 wt.-%, particularly 0.1 to 30 wt.-%, preferably 0.1 to 20 wt.-%, with reference to the end product. This can be done in such a manner that the material that is not capable of swelling, i.e. the tectosilicate, is added directly to the granular mass, or that it replaces the granular mass, in whole or in part. In addition, it is also possible to mix the material in question into the additives, or to disperse it in water and then mix it with the granular material and the additives, as well as additional water, if necessary.

Usually, quartz sand, zirconium sand, chromite sand, olivine sand, etc., are used as the granular mass. However, it is also possible, at this point, to use ceramic beads.

In addition, not only binders such as bentonite or binding clays, in general, can be used as additives, but rather supplementarily, carbon products such as glance carbon-forming agents, hard coal dust, or graphite can be used. These carbon products as additives ensure, during casting, because of their gas formation that occurs in this connection, that the grains of the granular mass, i.e. the quartz sand grains, are surrounded by glance carbon, so that the molding sand is prevented from burning onto the cast piece. In this way, a smooth and clean surface of the foundry castings is obtained. Also, the use of hard coal dust in the molding sand results in equalization of the sand expansion and in avoidance of sand defects. These aspects are fundamentally known (see EP 0 111 616 B1).

The addition of graphite (see EP 0 279 031 B1), according to the invention, results in better and faster absorption of the water by the material that is not capable of swelling, i.e. by the bentonite. In this way, it is easier to treat the molding sand or molding substance, and it reaches sufficient strength values for further processing more quickly. At the same time, the flow capacity of the molding sand or molding substance is improved by the addition of graphite, as described. Consequently, the uniformity during compaction of the molding sand increases. This means that the use of graphite as an additive for molding sands, which is actually known, causes the advantages explained in connection with EP 0 279 031 B1, within the scope of the invention, whereby synergy effects result from the combination with bentonite, which advantages lie in the easier treatment of the molding substance, the greater strength values, and the improved flow capacity.

In addition to the 0.1 to 20 wt.-% of structural silicates or tectosilicates, the mixture according to the invention, i.e. the molding sand in question, can contain 20 to 95 wt.-% of granular mass, with reference to the end product. 4 to 25 wt.-% binder clay and 1 to 12 wt.-% water are possible, with reference to the end product, in each instance. As already explained, the structural silicates or tectosilicates can replace the granular mass, in whole or in part, or can be contained in it. Consequently, a composition having 95 wt.-% of granular mass is possible, which contains up to 20 wt.-% of structural silicates or tectosilicates, and forms the 100 wt.-% of the mixture described, in combination with 4 wt.-% binder clay and 1 wt.-% water. 0.5 wt.-% of substances containing carbon can be contained in the 4 wt.-%.

In the end result, a new type of production method, particularly for molding sands that are conducted in a circulation system, for foundry purposes, is made available, which method is characterized by the fact that the molding sand or molding substance is equipped with a higher level of wash substance, in comparison with the state of the art, in other words demonstrates a greater proportion of fine particles. As a result, in combination with the added porous material that is not capable of swelling, changes in the water content during the treatment of the molding sand have a significantly lower effect than was the case until now. This means that the sensitivity to water exhibited by the molding substances becomes less.

At the same time, the water evaporation process during subsequent casting can be positively influenced by this. This is because due to the related thermal stress, a condensation zone forms, which is present in the state of the art as a relatively sharp border adjacent to the foundry casting. In comparison, the addition of the material that is not capable of swelling, according to the invention, results in a reduction in the steam diffusion speed in the molding substance or molding sand and, accompanying this, in a broadening of the condensation zone, which becomes a condensation region. In this way, not only does the wet tensile strength of the molding substance increase, but instead, at the same time, the tendency towards the formation of casting defects caused by the molding substance, such as scabbing and erosion defects, is suppressed.

The added porous material adsorbs and/or reacts with the organic crack products that necessarily form during every circulation cycle; as a consequence, these products generate fewer emissions than before, and furthermore do not make a negative contribution to influencing the molding substance and/or the foundry casting.

The pore volume made available by the material that is not capable of swelling, i.e. the cavities, can be adapted to specific (expected) crack products (with regard to their size and/or number), in targeted manner. This can be done by means of washing processes of natural bentonite, but also in that synthetic zeolite, for example, having predetermined properties, is used. In this way, the environmental compatibility can be tremendously increased.

Usually, in the production of the molding sand, a mixture of 20 to 95 wt.-% of granular mass, 4 to 25 wt.-% of active binder, e.g. montmorillonite or bentonite, up to 15 wt.-% water, particularly 1 to 12 wt.-% water, at least 0.1 wt.-% of materials containing carbon, generally approximately 0.1 to 20 wt.-% of additives containing carbon, usually approximately 0.5 wt.-% graphite, and approximately 0.1 to 40 wt.-%, particularly 0.1 to 30 wt.-%, preferably 0.1 to 20 wt.-% of tectosilicates are used. As an upper limit for the additives containing carbon, the invention recommends 20 wt.-%. All of the values are with reference to the end product, in each instance.

DETAILED DESCRIPTION OF PREFERRED EMBODIMENTS

The following formulations can be successfully used and are characterized by a high level of wet tensile strength and low sensitivity to water of the end product, i.e. the molding sand.

| | 1st example | 2nd example | 3rd example |
|---|---|---|---|
| Quartz | 80 wt.-% | 83 wt.-% | 83 wt.-% |
| Active binder clay (bentonite) | 8 wt.-% | 6.5 wt.-% | 7 wt.-% |
| Glance carbon binder, coal dust | 2 wt.-% | 3 wt.-% | 3 wt.-% |
| Burn-off residues, binder clay burnt dead | 5 wt.-% | 3 wt.-% | 2 wt.-% |
| Water | 3 wt.-% | 3 wt.-% | 3 wt.-% |
| Graphite | 0 wt.-% | 0.5 wt.-% | 0.5 wt.-% |
| Zeolite (clinoptilolith) | 2 wt.-% | 1 wt.-% | — |
| Fe zeolite (Fe clinoptilolith) | | — | 1 |
| Oxidant | — | — | 0.5 wt.-% |
| | 100 wt.-% | 100 wt.-% | 100 wt.-% |

Figure 1:
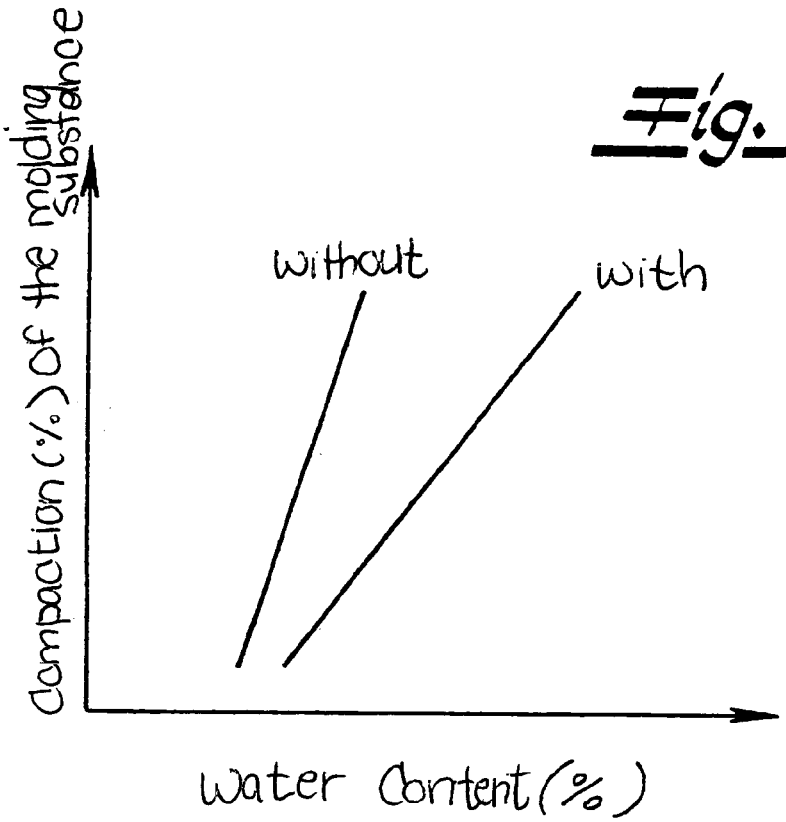
FIG. 1 shows a comparison of the molding sand produced according to the invention, "with" the additive of material that is not capable of swelling, with a molding sand that was produced "without" this porous material that is capable of swelling.

FIG. 1 compares the molding sand produced according to the invention, "with" the additive of material that is not capable of swelling, with a molding sand that was produced "without" this porous material that is capable of swelling. In this connection, the compaction of the molding substance or molding sand in % is compared with the water content (also in %).

It is evident that without the addition of the porous material that is not capable of swelling, according to the invention, even slight variations in the water content lead to strong variations in the compaction of the molding substance. In contrast, the greatly linear dependence of these two variables on one another is not (no longer) so greatly marked when the material that is not capable of swelling is added, and this explains the reduced sensitivity to water.

Figure 2:
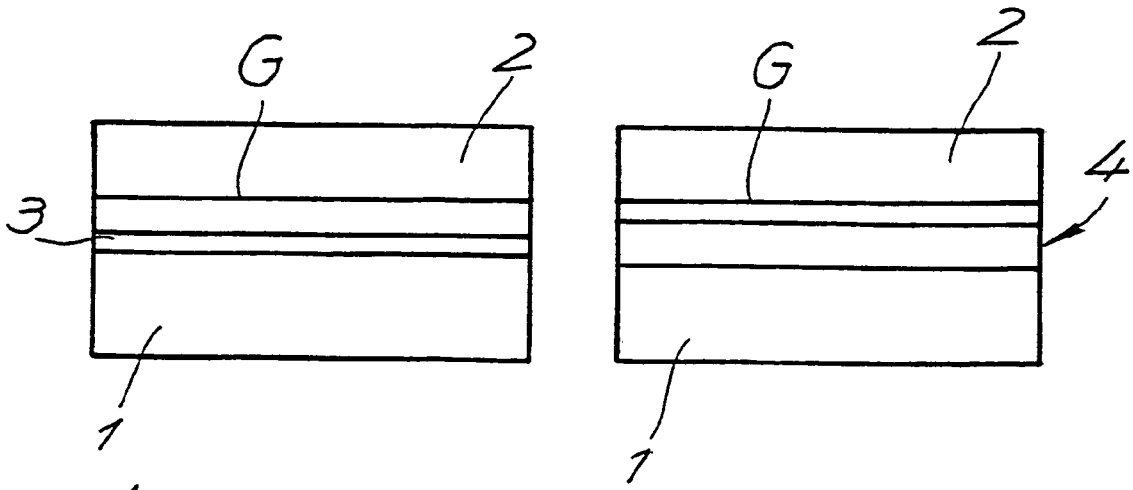
FIG. 2 shows a partial cross-section through a cast part, a foundry casting 2, produced in a mold 1, as shown schematically; and this zone defines a sharp border within the scope of the state of the art (left part of FIG. 2); in contrast, in the case of a mold made of the molding substance according to the invention, this condensation zone is broadened and forms a condensation region (right part of FIG. 2)

Within the scope of FIG. 2, a partial cross-section through a cast part, i.e. a foundry casting 2, produced in a mold 1, is shown schematically. In accordance with the example shown, a condensation zone 3 forms in the mold 1 during casting, at a certain distance from a border surface G between the mold 1 and the cast part 2; this zone defines a sharp border within the scope of the state of the art (left part of FIG. 2). This is specifically a border between an extensively water-free region of the mold 1, between the condensation zone 3 and the border surface G, and a moist region into the mold, which remains unchanged.

In contrast, in the case of a mold 1 made of the molding substance according to the invention, this condensation zone 3 is broadened and forms a condensation region 4 (right part of FIG. 2). This has the result that the strength of the mold 1 (as compared with the state of the art) increases, viewed over the cross-section, and this applies, at the same time, for the wet tensile strength.

This circumstance can be explained by the fact that the water that evaporates at the border surface G between the cast part 2 and the mold 1, as a result of the casting process, and flows into the mold, i.e. the steam, undergoes a reduction in terms of its flow velocity or steam flow velocity, because of the added additive (porous material that is not capable of swelling), and this results in the formation of the condensation zone 4.

Figure 3A:
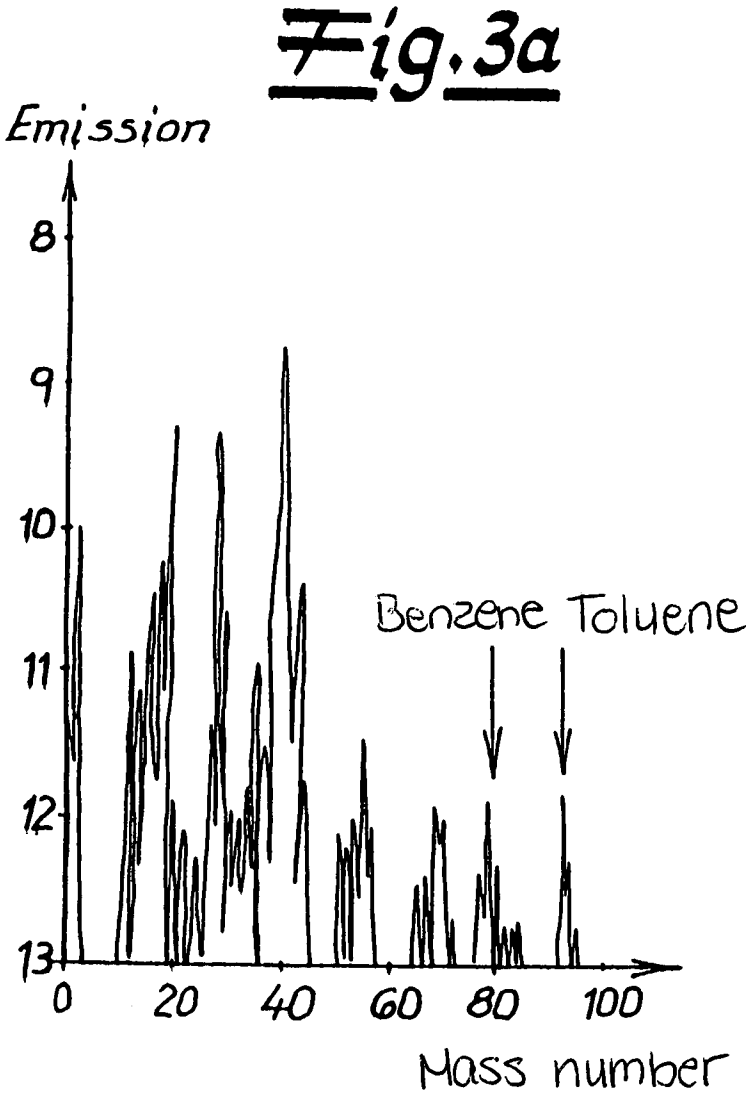
FIG. 3*a* shows that in the case of the conventional molding sand according to FIG. 3*a*, in other words a molding sand that was essentially produced "without" the porous material that is capable of swelling, clear components above the mass number 40 are registered.
Figure 3B:
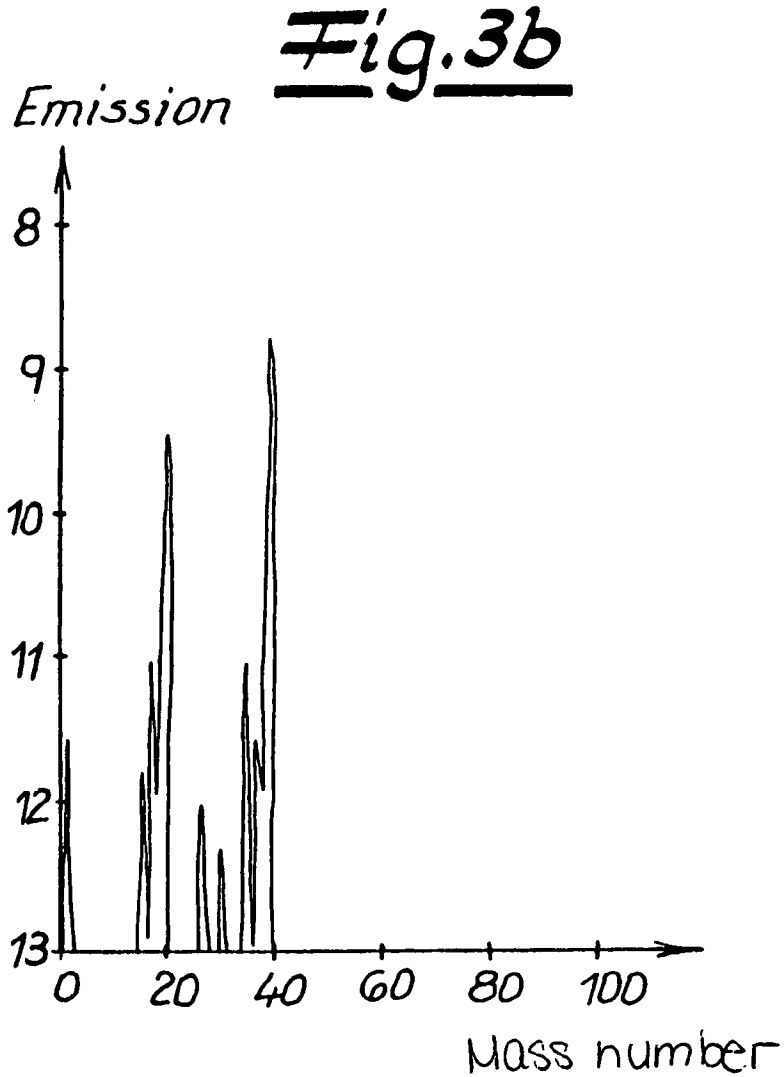
FIG. 3*b* shows that the molding sand according to the invention, in FIG. 3*b*, is characterized by almost no components in the mass range above 40.

Within the scope of the diagram according to FIGS. 3*a*, 3*b*, the measured (harmful substance) emissions of the molding sand produced according to the invention (FIG. 3*b*) are compared with molding sand used until now (FIG. 3*a*). The emissions of harmful substances have been detected in the course of pyrolysis, in other words dissociation triggered by heat, and shown by means of a mass spectrometer.

On the logarithmic y-axis, the emissions, in each instance, are plotted as a function of the electrical current of the measured ions in the mass spectrometer, while the x-axis, which is divided in linear manner, shows the mass number in relation to this.

It is evident that in the case of the conventional molding sand according to FIG. 3*a*, in other words a molding sand that was essentially produced "without" the porous material that is capable of swelling, clear components above the mass number 40 are registered. This is particularly true for benzene (mass approximately 80) or toluene (mass approximately 90), at the marked locations.

In contrast, the molding sand according to the invention, in FIG. 3*b*, is characterized by almost no components in the mass range above 40. In fact, at this location, Fe zeolite (Fe clinoptolith) was used as the porous material that is not capable of swelling. The emissions studied were recorded subsequent to a pyrolysis at 1300° C.

The invention recommends the use of hydrogen peroxide ($H_2O_2$), for example, ozone ($O_3$), or also oxalic acid and sodium percarbonate as well as other comparable oxidation agents, as particularly suitable oxidants for installation in the porous material that is not capable of swelling.

The invention claimed is:

1. Method for producing a molding sand, for foundry purposes, comprising adding a material that is not capable of swelling in water to a mixture of a granular substance and additives, and a porous material that is not capable of swelling has cavities having a specific surface area of more than 10 $m^2/g$, and treating the porous material that is not capable of swelling chemically and/or physically in such a way that oxidants are built into its cavities.

2. Method according to claim 1, wherein cations and the oxidants are built into the cavities.

3. Method according to claim 1, wherein a binder as well as water are used as additives.

4. Method according to claim 1, wherein the porous material that is not capable of swelling has cavities having a specific surface area of more than 50 $m^2/g$.

5. Method according to claim 1, wherein the porous material that is not capable of swelling has a crystal structure and is equipped with pores for embedding harmful and/or odor-causing substances, without any significant change in the crystal structure.

6. Method according to claim 1, wherein the material that is not capable of swelling has a low density of less than 3 $g/cm^3$.

7. Method according to claim 1, wherein the material that is not capable of swelling is a natural or synthetic material.

8. Method according to claim 1, wherein hydrogen peroxide, oxalic acid, ozone, sodium percarbonate, are used as oxidants.

9. Method according to claim 1, wherein structural silicates or tectosilicates, zeolite, but also pumice or pumice stone, allophane, imogolite, siliceous earth, polygarskites, sepiolites, diatomaceous earth, clays (treated with acid and/or heat), are used as porous materials that are not capable of swelling.

10. Method according to claim 1, wherein the material that is not capable of swelling is added in amounts of approximately 0.1 wt.-% to approximately 40 wt.-%, with reference to an end product.

11. Method according to claim 1, wherein the material that is not capable of swelling is added directly to the granular substance, the additives, or dispersed in water.

12. Method according to claim 1, wherein a special zeolite, Fe zeolite or chabasite, is used as the porous material that is not capable of swelling.

13. Method according to claim 1, wherein quartz sand, zirconium sand, chromite sand, olivine sand, or ceramic beads are used as the granular substance.

14. Method according to claim 1, wherein a mixture is formed, which consists of 20 to 95 wt.-% of granular mass, 4 to 25 wt.-% of active binder clay, 1 to 12 wt.-% of water, 0.1 to 20 wt.-% of substances containing carbon, and 0.1 to 40 wt.-%, of structural silicates or tectosilicates.

15. Method according to claim 1, wherein the porous material that is not capable of swelling has cavities having a specific surface area of more than 100 $m^2/g$.

16. Method according to claim 1, wherein the material that is not capable of swelling has a low density of less than 2.5 $g/cm^3$.

17. Method according to claim 1, wherein a mixture is formed, which consists of 20 to 95 wt.-% of granular mass, 4 to 25 wt.-% of active binder clay, 1 to 12 wt.-% of water, 0.1 to 20 wt.-% of substances containing carbon, and 0.1 to 20 wt.-%, of structural silicates or tectosilicates.

* * * * *